US005794648A

United States Patent [19]

Jentzsch et al.

[11] Patent Number: 5,794,648

[45] Date of Patent: Aug. 18, 1998

[54] HOSE WINDING APPARATUS

[76] Inventors: Horst Jentzsch, Waldenbucher Strasse 9, D-72631 Aichtal; Berthold Schuppler, Haldenweg 37, D-73249 Wernau, both of Germany

[21] Appl. No.: 588,534

[22] Filed: Jan. 18, 1996

[51] Int. Cl.[6] ..... A01M 7/00

[52] U.S. Cl. ..... 137/355.23; 137/355.22

[58] Field of Search ..... 137/355.21, 355.22, 137/355.23

[56] References Cited

U.S. PATENT DOCUMENTS 1,453,999 5/1923 Royer ..... 137/355.21

1,829,161 10/1931 Smithson et al. ..... 137/355.21

*Primary Examiner*—A. Michael Chambers

*Attorney, Agent, or Firm*—Kokjer, Kircher, Bowman & Johnson

[57] ABSTRACT

A winding-up attachment for a long, flexible element, in particular a hose, comprises a rotatable drum for winding-up and for unwinding the element. A return device rotates the drum in the winding-up direction or in the unwinding direction, respectively. It comprises an automatic brake for stopping the winding-up process or the unwinding process, respectively, at a predetermined rotary stop position of the drum in which the element has been wound up or unwound, respectively, in full, except for a defined residual length. The brake comprises a winding-up device that rotates together with the drum and winds/unwinds an elongated, flexible braking element, e.g. a cord. The braking element is wound about an outer surface of the drum in several windings. One terminal end of the braking element is connected with a circumferential surface of the drum. The braking element is sized such that when the drum reaches the predetermined stop position, it is stopped by a tension force within the braking element. A section, in particular a winding, of the braking element is lifted off the peripheral surface of the drum and is guided around a stationary deflection point.

14 Claims, 3 Drawing Sheets

HOSE WINDING APPARATUS

FIELD OF THE INVENTION

The present invention relates to a winding-up attachment for a long, flexible element, especially a hose, cable, rope or the like, having a rotatable drum for winding up or unwinding the element, a return device for rotating the drum in the winding-up direction or unwinding direction, and an automatic brake for stopping the winding-up or unwinding process effected by the return device, in a predetermined rotary position of the drum in which the element has been wound up or unwound in full, except for a defined residual length, the brake comprising a winding-up device, that revolves together with the drum, for an elongated, flexible braking element that is wound about an outer surface of the drum in several windings, whose one end is connected with a circumference of the drum and that is sized in such a way that when the drum reaches a predetermined position it is forcedly stopped by a tension force in the braking element.

DISCUSSION OF THE PRIOR ART

U.S. patent specification Ser. No. 1,453,999 discloses a hose winding apparatus of the kind mentioned above.

Another hose winding apparatus for exhaust-gas extraction systems has been known from a company publication entitled "NORFI hat das groβe Program fortschrittlichster Umwelttechnik" (1991). This prior art winding-up attachment comprises a drum for the hose. The drum is driven by an electric motor designed as brake motor. The free end of the hose can be connected to the exhaust of a motor vehicle by means of a suitable socket. The other end of the hose is fastened on a hollow shaft of the drum. A pipe end with swiveling coupling, which projects radially from the drum, permits the exhaust gas to be extracted and disposed of by means of a suitable blower.

In addition to the before-mentioned hose winding-up attachments, which are driven by electric motors, there have also been known for the before-mentioned application other types of winding-up attachments that comprise a spring-loaded return device. The spring is tensioned during unwinding of the hose and locked in position by a blocking means when the hose is in its unwound condition. When the hose is to be wound up later, the blocking means is disengaged, and consequently the tensioned spring drives the drum in such a way that the hose is wound up again in full, or except for a given residual length.

Winding-up attachments of this type have been known also in connection with electric appliances, such as vacuum cleaners, where the line cord may be unwound and wound up again in the described way.

It is a requirement with such spring-loaded return devices that the rotation of the drum must be stopped in a predetermined rotary position in which the hose, the cable or the like has been wound up except for a defined residual length. The residual length is such as to permit the hose or the cable, or a socket on the hose or a plug on the cable, to be grasped by hand.

Stopping the drum is normally achieved with such known return devices by having the hose or cable pass through an opening whose diameter is only slightly larger than that of the hose or cable. The larger socket or the larger plug, or a sleeve fitted on the hose for this purpose, will then be trapped by the opening, whereby the action of the return device, i.e. the winding-up movement of the drum effected by it, is stopped abruptly.

It is, therefore, a disadvantage of the known devices that a very high and abrupt tension force is exerted on the hose or the cable when the predetermined rotary position or the final position of the drum is reached. This may lead to damage during prolonged operation, for example by electric contacts breaking at the transition from the cable to the plug, or by cracks developing in the hose socket through which exhaust gas may escape.

Another disadvantage of the known arrangements appears when the defined residual length, i.e. the length remaining unwound in the final position of the drum, has a greater length. This is true for exhaust-gas extraction units because hose winding-up attachments used for such applications are normally mounted on the underside of the ceiling of the factory or workshop because in this case the free end must hang down a sufficient length, even in the wound-up condition of the hose, to permit a fitter to grasp it by his hand. This means that in such cases the free residual length may well be in the range of 2 m or even more. In the case of certain known hose winding-up attachments, one now achieves stopping of the drum by fitting the before-mentioned sleeve, which has a diameter clearly larger than that of the hose, on the hose a corresponding distance away from the free end of the hose, or from the socket mounted on that end. During winding-up of the hose, the sleeve then abuts against the frame of the drum arranged at a small distance above the wound-up hose windings. Now, the sudden stoppage of the drum may give rise to a "whip effect", which means that the free end of the hose, with the socket fitted thereon, will flick forth and back at very high speed and at the level of the fitters' heads. This may lead to injuries under unfavorable conditions or if the fitters should be inattentive.

It is further a disadvantage of that solution that the sleeve of larger diameter may get displaced, due to the axial load acting on the hose, and that as a consequence thereof the free residual length of the hose may change; moreover, damage may occur in the area of the sleeve.

U.S. patent specification Ser. No. 1,453,999, mentioned at the outset, discloses a winding-up attachment for an air hose of the kind used by gasoline stations or the like for pumping up pneumatic tires of motor vehicles.

The air hose is wound up on a drum, and one end of the air hose can be connected to a stationary compressed-air connection via the shaft of the drum. The other free end of the air hose can be unwound from the drum. The drum is provided with a return spring so that the unwound length of the air hose can be automatically wound up again on the drum upon completion of the pumping-up operation. In order to avoid damage of any kind that may occur when the drum is stopped abruptly at the end of the winding-up process, a braking means is provided. The braking means comprises a chain that is wound about an outer surface of smaller diameter of the drum arrangement. One end of the chain is fixed on the outer surface. The other end of the chain leads away from the outer surface of the drum and to the free end of a piston rod of a piston and cylinder unit whose cylinder is connected with the winding-up attachment in fixed spacial relationship. The length of the chain is selected in such a way that the chain will be completely wound up at the end of the winding-up process of the air hose and will tend to pull the piston out of the cylinder shortly before the end of the constructionally possible winding-up process. So, the end of the winding-up process of the air hose is braked by the damping effect of the piston and cylinder unit.

The known arrangement is connected with the disadvantage that numerous complex components are needed, especially a piston and cylinder unit, and that in addition considerable mounting space is required.

Now, it is the object of the present invention to improve a winding-up attachment of the before-mentioned kind in such a way that the process of stopping the drum can be controlled by simple and robust means so as to enable the deceleration during the stopping process of the drum to be adjusted in the known way and the wear of the elements involved to be kept at a minimum. This is intended, for example in applications in exhaust-gas extraction systems, to save the hose of the extraction unit, which is very expensive as it has to be resist high temperatures, and to clearly extend the service life of the winding-up attachment. Further, by providing the possibility to influence the braking operation as such, the "whip effect" can be avoided due to the possibility to make the braking process of the drum so gentle as to ensure that the free end of the hose or the cable will move only slightly when the drum is stopped.

SUMMARY OF THE INVENTION

According to the invention, this object is achieved by the fact that successive sections, especially successive windings, of the braking element are lifted off the outer surface of the drum and are guided around a spatially fixed deflection point.

The object underlying the present invention is thus achieved in full.

The invention in fact provides the advantage that a very compact structure is obtained because the entire brake may simply consist of a rope, a tape or the like wound up in several windings. The rope or the like is slightly lifted off the drum only at a single point, namely in the area of a winding. Consequently, the transition from free rotation of the drum to its braked position will automatically take place very gradually because the free path length is also reduced very gradually under the existing geometric conditions. This then leads to a steady, i.e. gradual braking effect already when the rope, or the like, used is itself inextensible. This makes the whole arrangement extremely simple, robust and easily exchangeable in case of wear with simple means and without greater cost.

An especially good effect is achieved with the invention when an elastic braking element is used.

This feature provides the advantage that the drum can be braked even more gently and in a controlled way because when the predetermined rotary end position is reached, the tension force acting in the long flexible braking element has the effect to further delay the stopping of the brake.

In this connection a solution is particularly preferred where the braking element comprises a substantially inextensible cord or the like, and a spring inserted in the cord.

This feature provides the advantage that on the one hand a mechanically highly stable element, such as a cord, a wire, a rope or the like can be used, while on the other hand the desired elasticity is obtained by the spring whose spring characteristic can be selected within very broad ranges.

It is preferred in this connection that the spring should be arranged in that section of the braking element that is lifted when the drum occupies the predetermined rotary position.

This feature provides the advantage that the spring can extend and relax while in the free path length.

According to a preferred embodiment of the invention, the deflection point is a stationary roller.

This feature provides the advantage that the braking element can be guided about the deflection point practically free from wear.

It is further preferred that the braking element encompasses an angle of between 50° and 100° of the outer surface at the point of deflection.

Practical tests have shown that these dimensions are particularly advantageous.

According to a variant of the invention, the braking element has its two ends fixed at a mounting point on the outer surface of the drum.

This feature provides the advantage that the whole braking element is easily accessible and can be exchanged easily in case of need.

According to a further development of that embodiment of the invention, both ends are fixed at one and the same mounting point.

This feature provides the advantage that a single mounting point is required only which has the effect to simplify the assembly process and to reduce the production cost.

According to another group of embodiments, the braking element has one of its ends fixed at a first mounting point on the outer surface of the drum and its other end at a second mounting point of an auxiliary drum arranged to rotate in response to the rotation of the drum.

This feature provides the advantage that the braking element is wound up or unwound, respectively, only on the drum or the auxiliary drum, respectively.

According to other embodiments of the invention, the braking element is wound up on the outer surface of the drum under longitudinal tension.

This feature provides the advantage that the braking element is guided safely on the outer surface of the drum and that fouling of the element is excluded due to the prevailing tension.

Further, embodiments of the invention are preferred where the outer surface of the drum serves simultaneously as winding-up surface for the element.

This feature again provides the advantage that a particularly simple structure is achieved because the winding-up surface for the element, i.e. the hose, the cable or the like, is anyway present so that no separate components are needed when the braking element is also wound up on that winding-up surface.

Other advantages will become apparent from the specification and the attached drawing.

It is understood that the features mentioned above and those yet to be explained below can be used not only in the respective combinations indicated, but also in other combinations or in isolation, without leaving the scope of the present invention.

BRIEF DESCRIPTION OF THE DRAWINGS

One embodiment of the invention will be explained hereafter in more detail with reference to the drawing in which.

DETAILED DESCRIPTION OF THE PREFERRED EMBODIMENT

Figure 1:
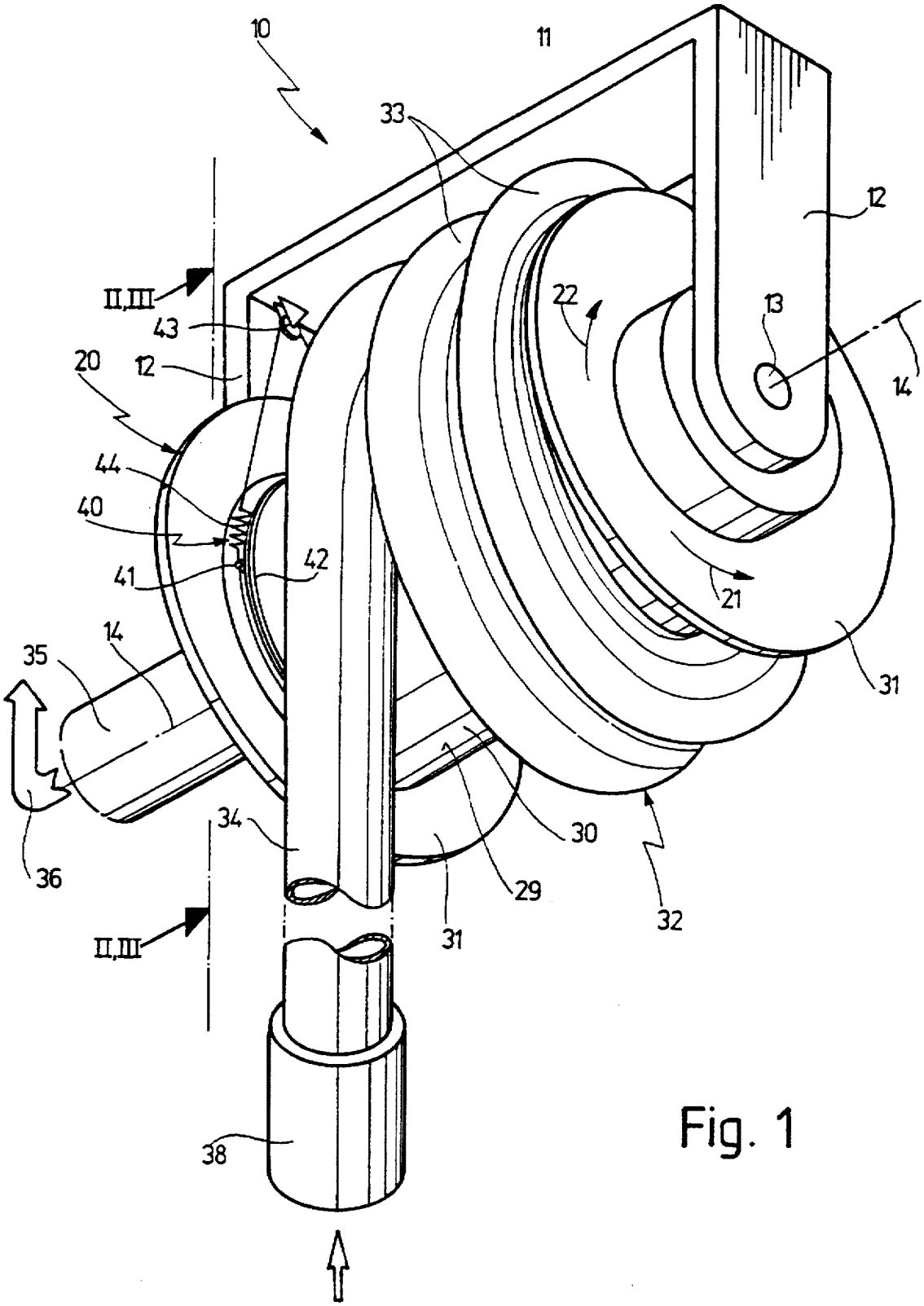
FIG. 1 shows perspective view of a hose winding-up attachment of the kind used for example in exhaust-gas extraction systems.

Regarding now FIG. 1, a hose winding-up attachment of the kind used in exhaust-gas extraction systems is designated generally by reference numeral 10. Systems of this kind are usually present in factory or assembly buildings or workshops where motor vehicles are present with their motors running. The hoses wound up on the hose winding-up attachment serve the purpose to extract the exhaust gas at the very exhausts of the motor vehicles, and to carry it off the building via a central exhaust-gas disposal system.

It is understood in this connection that the winding-up attachment according to the invention may be used for a plurality of different applications. For example, the embodiment illustrated in the figures need not necessarily be used for extracting exhaust gases. Rather, the hose winding-up attachment may also be employed for exhausting dusts, or for the supply of air or other gases.

Further, the winding-up attachment according to the invention may be employed for the supply or removal of liquids. Examples for an application of this kind are hoses of the type used on tank vehicles, for example for supplying liquid fuel to private users, industrial users or gasoline stations. Another application that can be accommodated in this way is the supply and disposal of water, for example on fire-fighting vehicles or at washing installations. Quite generally, the winding-up attachment may be used as means for winding up hoses for any flowing media of any kind. Other areas of application of the winding-up attachment are, for example, cables, tapes, cords, wires, ropes and many other things more. Accordingly, the embodiment that will be described hereafter may by no means be understood as limiting the use of the invention to the described example.

The hose winding-up attachment 10 is mounted upside down on a mounting frame 11 which is fixed either on a ceiling or a wall of the assembly building or on a suitable supporting structure. Two flanges 12 extending laterally downward from the supporting frame 11 support a shaft 13 extending therebetween along an axis 14.

The shaft 13 supports a drum 20 whose two senses of rotation are indicated by arrows in FIG. 1. Arrow 21 indicates the unwinding direction, arrow 22 the winding-up direction.

The drum 20 is equipped on one side with a return device 23, which is indicated only diagrammatically in FIG. 1. The return device 23 comprises a spring—not shown in the drawing—which is tensioned in the unwinding direction 21 of the drum 22 and is locked in this position by means of a suitable latch as long as the unwound hose is used for extracting exhaust gas. Once the latch has been released, for example by sudden rotation of the drum 20 in the unwinding direction 21, the return device 23 causes the hose to be wound up again on the drum 20, except for a defined free residual length by which the free end of the hose remains hanging down after the hose has been wound up "completely". The dimension of the free residual length is selected in such a way that the free end of the hose, with a socket mounted thereon, remains suspended at a height of, for example, 2 m from the floor of the workshop so that the free end can be grasped by hand.

The drum 20 is formed substantially by a cylindrical outer surface 29 of a drum body 30. The drum body 30 is provided on its axial ends with disk-like walls 31 that prevent the wound-up hose 32 from slipping off laterally.

Regarding now the representation of FIG. 1, the hose 32 is wound up on the outer surface 29 by approximately two and a half windings 33, with a straight section hanging down at the front.

An axially extending pipe end 35 indicated diagrammatically on the left side of the drum 20 is connected with the rotatable drum body 30 via a swiveling coupling. As indicated by arrow 36, exhaust gas can be extracted through the axial pipe end 35, the drum body 30 being hollow for this purpose. To this end, the right-hand end of the hose 32—not shown in FIG. 1—is fastened on the drum body 30, with its end opening into the hollow space of the drum body 30. Now, then exhaust gas is extracted by means of the hose 32, as indicated by arrow 37, the exhaust gas enters the inner space of the drum body 30, from where it is guided through the axial pipe end 35 and then—by means of a blower not shown in the drawing—into an exhaust gas disposal system.

The drum 20 is provided with a brake indicated generally by reference numeral 40.

The brake 40 comprises a mounting point 41 on the outer surface 29 of the drum body 30. Starting at the mounting point 41 in FIG. 1, a cord 42 or the like is run in downward direction and is wound around the drum body 30 by several windings, as can be clearly seen in FIG. 1. The cord 42 then runs about a stationary roller 32 and back to the mounting point 41 where it is fastened via a spring 44. The stationary roller 43 is spatially fixed relative to the rotatable drum 20, being fastened for example on the bottom face of the mounting frame 11.

The number of windings of the cord 42 corresponds to the number of windings 33 of the hose 32, with the particularities that will be described hereafter.

Figure 3:
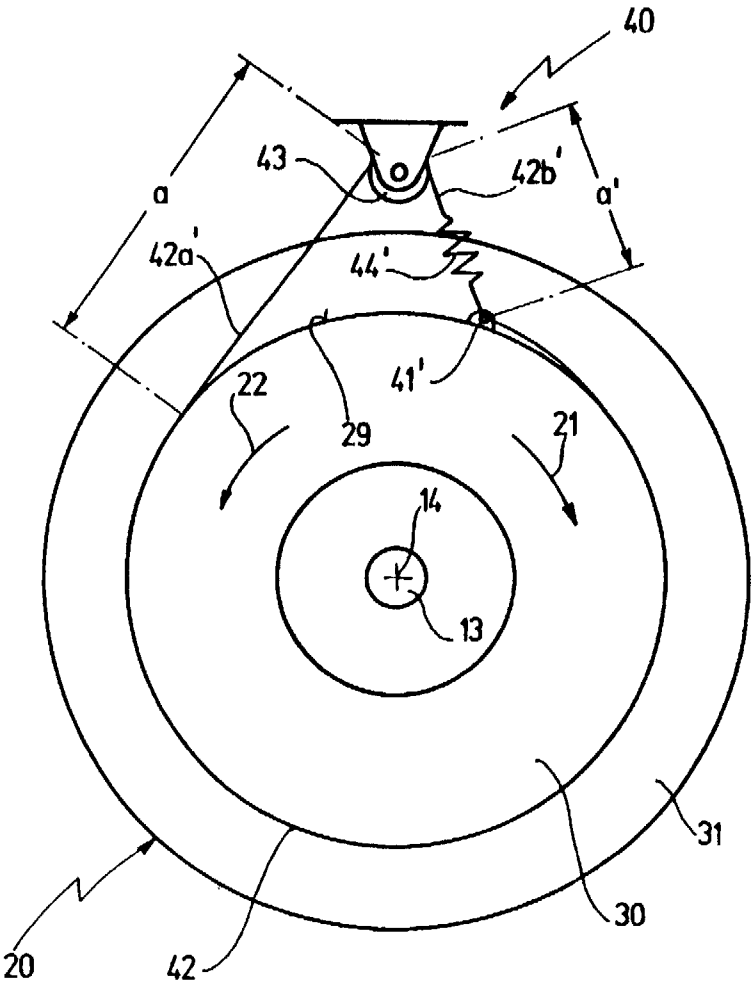
FIG. 3 a representation similar to that of FIG. 2, but showing a second operating condition in which a drum of the hose winding-up attachment is being braked.
Figure 2:
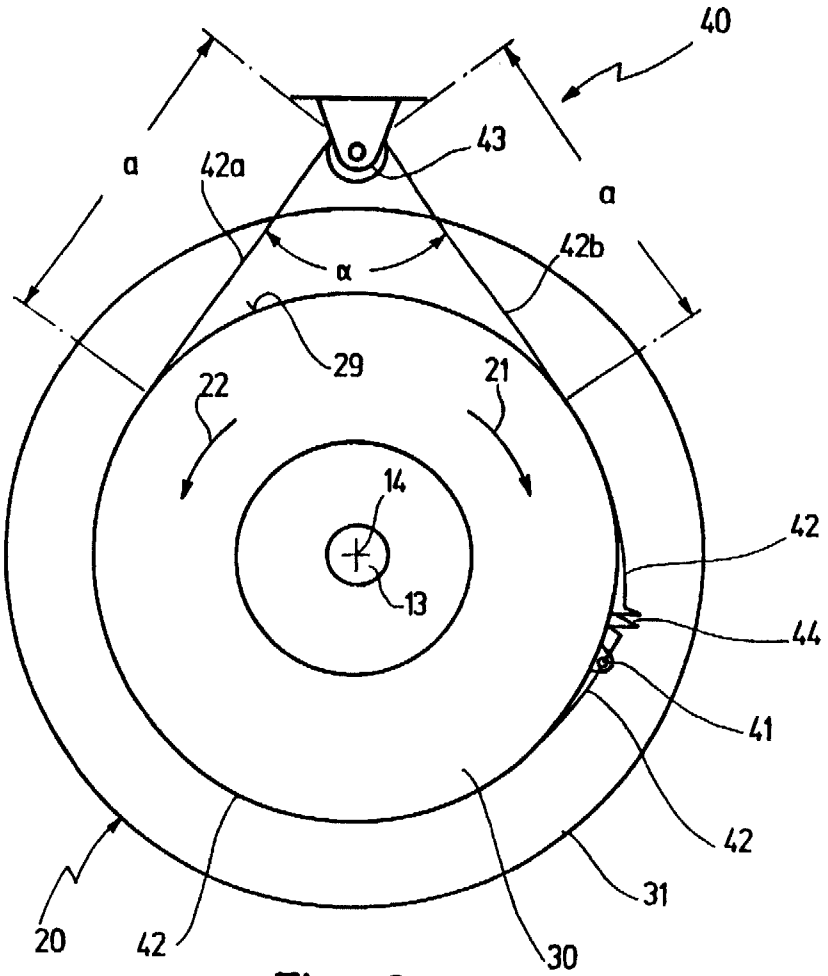
FIG. 2 a diagrammatic representation, taken along line II—II in FIG. 1, in a first operating position.

The operation of the brake 40 is depicted diagrammatically in FIGS. 2 and 3.

FIG. 2 shows the operating condition in which the drum 20 is allowed to rotate freely. In this condition, the cord 42 runs uniformly around the stationary roller 43, being on the one hand wound up on, and on the other hand unwound from the outer surface 29 of the drum, depending on its sense of rotation 21, 22.

The free path lengths or sides **42*a*, 42*b* of the cord 42, between the outer surface 29 of the drum and the stationary roller 43, form common tangents and consequently have the same length a. They include between them, above the outer surface 29 of the drum, an angle $\alpha$ of, preferably, between 500 and 1000**.

The spring 44 is substantially relieved in this operating condition, providing merely a certain pre-tension for the cord 42 during the winding-up and unwinding process.

Now, when the drum 20 approaches its predetermined rotary end position, shown in FIG. 3, in which the drum 20 is to be stopped, the side **42*b* of the cord 42 at the right of the rollers 43 in the representation of FIG. 3 gets shorter. This is due to the fact that as the drum approaches its rotary end position, the end of the cord 42 fastened on the mounting point 42 likewise approaches the stationary roller 43. The free path length 42*b* is now no longer a common tangent to the stationary roller 43 and the outer surface 29 of the drum but becomes a relatively shorter side forming a tangent only to the stationary roller 43, its angle relative to the outer surface 29 of the drum being greater than 0°. This shorter free path length is illustrated in FIG. 3 as shorter cord side 42*b*'**. Its length a' is shorter than the unshortened length a.

This results in a tension force being exerted on the spring 44, which is thereby extended and tensioned, as illustrated at 44' in FIG. 3.

The transition from free rotation of the drum 20 to its braked condition then necessarily takes place gradually because the free path length likewise decreases gradually from **42*b* (FIG. 2) to 42*b*' (FIG. 3) due to the prevailing geometric conditions. In addition, there is the gradual extension of the spring 44, without which the position illustrated in FIG. 3 would in fact not be possible, the cord 42 being otherwise inextensible in the longitudinal direction. The drum 20 is thus stopped in the position illustrated in FIG. 3. This is a position in which the abutment point 41' still lies before the position—in the winding-up direction 22—in which the outer surface 29 intersects the connection line between the axis 14 of the drum 20 and the axis of the stationary roller 43**.

The drum 20 is stopped in this way with a predetermined deceleration, i.e. by a smooth stopping process. Still, the brake 40 consists of only few extremely simply elements, namely the cord 42 with its spring 44 and the mounting point 41, and the stationary roller 43. These elements can be produced and assembled at extremely low cost and can be exchanged easily in case of need.

Figure 5:
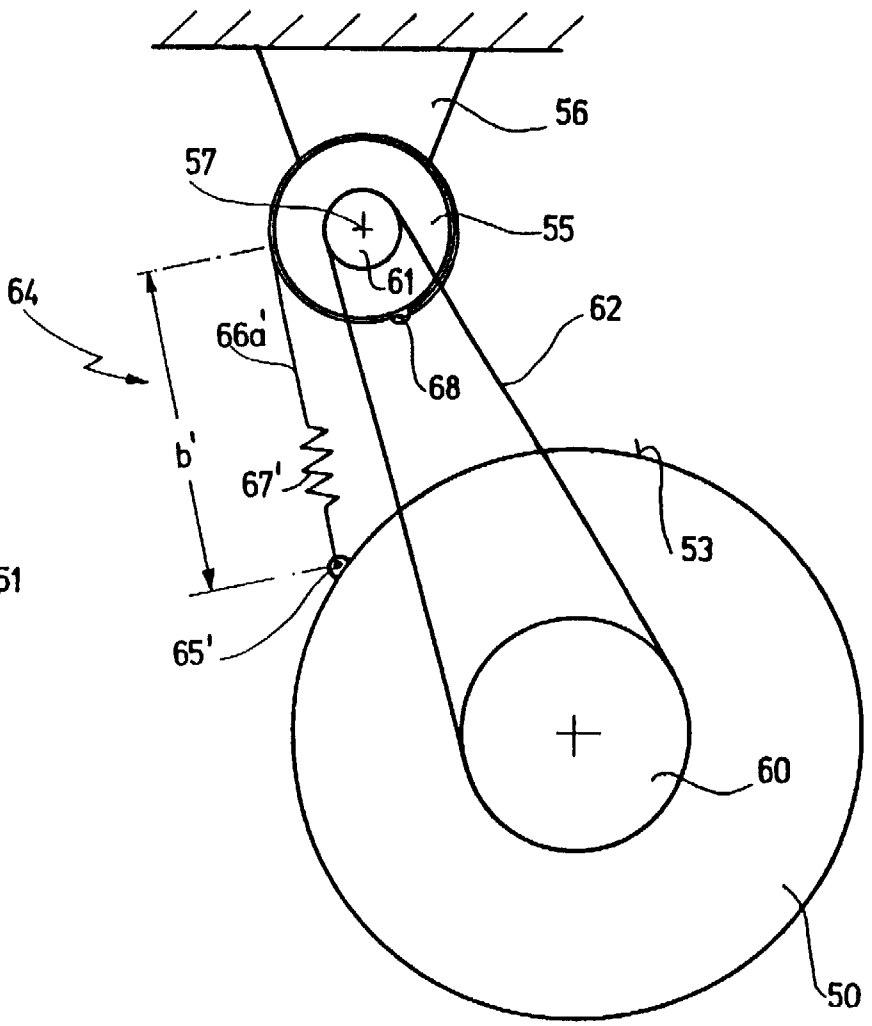
FIG. 5 a representation similar to that of FIG. 5, but showing a second operating position in which a drum of the hose winding-up attachment is being braked.
Figure 4:
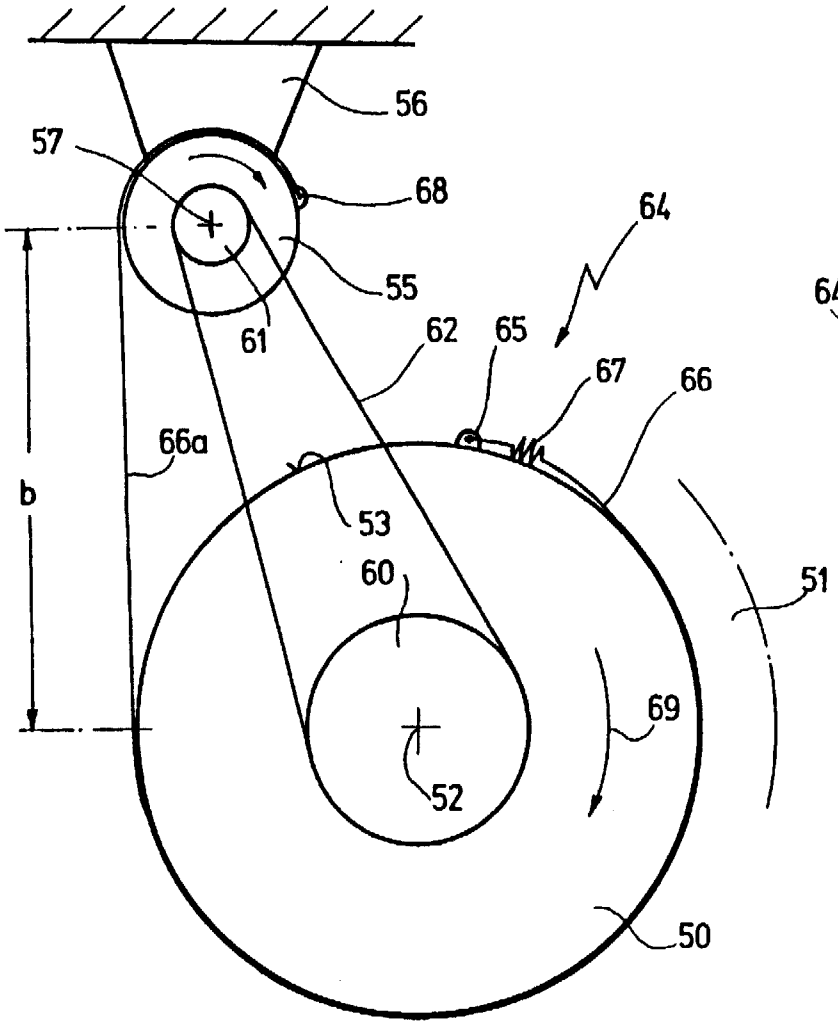
FIG. 4 a diagrammatic representation similar to that of FIG. 2, but showing a different embodiment of the invention.

FIGS. 4 and 5 show another embodiment of a winding-up attachment according to the invention. The illustration is similar to that of FIGS. 2 and 3.

The winding-up attachment according to FIGS. 4 and 5 comprises again a drum 50 about which a hose 51 or the like can be wound up. The drum 50 can rotate about an axis 52. An outer surface of the drum 50 is designated by reference numeral 53.

At a certain spacing from the drum 50, there is provided an auxiliary drum 55, preferably mounted in spatially fixed arrangement on a holder 56. The auxiliary drum 55 can rotate about an axis 57 that preferably extends in parallel to the axis 52 of the drum 50.

The drum 50 carries on one side a belt pulley 60, while a properly aligned belt pulley 61 is provided on the auxiliary drum 55. The belt pulleys 60, 61 are connected by a belt 62. The diameters of the belt pulleys 60, 61 are selected in such a way that the drum 50 and the auxiliary drum 55 revolve at the same circumferential speeds.

A brake indicated generally by reference numeral 64 comprises a first mounting point 65 on the outer surface 53 of the drum. A cord 66 fixed on the first mounting point 65 comprises a spring 67 inserted in the cord near the first mounting point 65. The cord 66 is wound about the drum 50, preferably by several turns, and the free end **66*a* of the length b is then run to the auxiliary drum 55; there the cord is wound about the auxiliary drum 55, likewise preferably by several turns, and fastened at the second mounting point 68**.

When the drum 50 rotates, for example in the direction indicated by arrow 69, the cord 66 is gradually unwound from the outer surface 53 of the drum 50 and wound up on the auxiliary drum 55. The cord 66 as such remains tensioned because the circumferential speeds of the drum 50 and of the auxiliary drum 55 are equal, as has been mentioned before.

Now, when the cord 66 has been unwound from the drum 50, the first mounting point 65 moves to the position 65' in FIG. 5, i.e. beyond the imaginary point of contact of the common tangent to the drum 50 and the auxiliary drum 55, as will be immediately apparent when comparing FIGS. 4 and 5. The end of the cord 66 now indicated by reference numeral **66*a*' is thus reduced in length, as indicated by b' in FIG. 5. The spring 67'** is tensioned in this condition.

Consequently, the drum 50 is again gently braked and stopped in the manner described before with reference to FIG. 3.

It is understood that the embodiment illustrated in FIGS. 1 to 5 can be modified in a plurality of ways.

For example, the cord need not necessarily be wound up on that outer surface of the drum which is intended for the hose. Instead, a separate winding-up surface may be provided for the cord, depending on the necessities of the particular case.

Further, there is the possibility to use an entirely elastic braking element, for example a rubber cord, instead of a longitudinally inextensible cord (or a corresponding wire, rope or the like) with a spring.

The mechanisms described above with reference to FIGS. 1 to 5 may be used also with their roles reversed. Instead of winding up a hose or the like in full or except for a free residual length, under the effect of the return device, and then braking it with the aid of the described brake, the same mechanism may be provided also for the unwinding operation, if for example the hose has to be unwound quickly, as may be the case for example in a fire-fighting vehicle. In this case, it may then be convenient to gently brake the drum at the end of the unwinding process so as not to subject the connection point between the hose and the drum to undue mechanical stresses.

In addition, the arrangement described before may be employed also in connection with motor-driven winding-up or unwinding elements, if the drum used for that purpose is provided with a slip coupling, by means of which the drum can be braked gently at the end of the winding-up and/or unwinding operation and the drive, which initially continues in effect, is allowed to freewheel via the slip coupling. This would have the result to stop the drum in a defined position and to remove stress from the otherwise loaded elements.

What is claimed is:

1. An apparatus for winding an elongate, flexible element comprising:

a rotatable drum for winding-up and for unwinding, respectively, said element on a first peripheral surface of said drum;

return drive means for rotating said drum in a winding direction; and brake means for automatically stopping rotation of said drum caused in said winding direction by said return drive means, said stopping being effected at a predetermined rotary stop position of said drum when said element is wound onto said drum except of a predetermined residual length of said element, said brake means comprising an elongate, flexible braking element being wound around a second peripheral surface of said drum with several windings, a section of said wound braking element being lifted-off said second peripheral surface and guided around a stationary deflection point, said braking element having, further, a first terminal end attached to said second peripheral surface and having a predetermined length so as to stop rotation of said drum at said predetermined rotary stop position by means of a pull force in said braking element.

2. The apparatus of claim 1, wherein said braking element is elastic.

3. The apparatus of claim 2, wherein said braking element comprises a substantially inextensible cord and a spring inserted therein.

4. The apparatus of claim 3, wherein said spring is arranged within said lifted-off section of said braking element when said drum is at said predetermined rotary stop position.

5. The apparatus of claim 1, wherein said deflection point is a stationary roller.

6. The apparatus of claim 1, wherein said braking element is guided around said deflection point with an angle $\alpha$ of between 50° and 100°.

7. The apparatus of claim 1, wherein said braking element has two terminal ends attached to a mounting point on said second peripheral surface of said drum.

8. The apparatus of claim 7, wherein both terminal ends are attached to the same mounting point.

9. The apparatus of claim 1, wherein said braking element has said first terminal end attached to a first mounting point on said second peripheral surface of said drum, and has a second terminal end attached to a second mounting point on an auxiliary drum arranged to rotate in response to the rotation of said drum.

10. The apparatus of claim 1, wherein said braking element is wound on said second peripheral surface of said drum under longitudinal tension.

11. The apparatus of claim 1, wherein said first peripheral surface and said second peripheral surface coincide.

12. The apparatus of claim 1, wherein said elongate, flexible element is a hose.

13. The apparatus of claim 1, wherein said elongate, flexible element is a cable.

14. The apparatus of claim 1, wherein said elongate, flexible element is a rope.

* * * * *